United States Patent [19]

Strecker

[11] 4,188,539

[45] Feb. 12, 1980

[54] NUCLIDE GENERATOR FOR PREPARING RADIO-NUCLIDES

[75] Inventor: Helmut Strecker, Seeheim, Fed. Rep. of Germany

[73] Assignee: Hoechst Aktiengesellschaft, Frankfurt, Fed. Rep. of Germany

[21] Appl. No.: 888,756

[22] Filed: Mar. 21, 1978

[30] Foreign Application Priority Data

Mar. 23, 1977 [DE] Fed. Rep. of Germany ..... 2712635

[51] Int. Cl.[2] ..... H01J 27/00

[52] U.S. Cl. ..... 250/432 PD; 250/515

[58] Field of Search ..... 250/432 PD

[56] References Cited

U.S. PATENT DOCUMENTS

| | | | |
|---|---|---|---|
| 3,156,532 | 11/1964 | Doering | 250/432 PD |
| 3,814,941 | 6/1974 | Czaplinski | 250/432 PD |
| 4,020,351 | 4/1977 | Gemmill | 250/432 PD |

*Primary Examiner*—Harold A. Dixon

*Attorney, Agent, or Firm*—Curtis, Morris & Safford

[57] ABSTRACT

Nuclide generators for preparing sterile and pyrogen-free radioactive solutions consist of a generator column which is provided with radiation shielding and connected to a container for eluting agent and has a connection to a container for eluate. The generator and the container for eluting agent are located in vessels with centering devices, wherein the generator column with its radiation shielding is located in a fixed position relative to the vessel between two centering devices and connected via a cannula to the container for eluting agent which is held in a recess of one centering device in a fixed position relative to the generator column. The other centering device has also a recess for guiding and holding the eluate container which is connected to the generator column via a cannula.

6 Claims, 2 Drawing Figures

NUCLIDE GENERATOR FOR PREPARING RADIO-NUCLIDES

BACKGROUND OF INVENTION

Short-lived ratio-nuclides are increasingly used for in-vitro diagnostics due to their low radiation exposure.

To prevent a loss of radioactivity due to radioactive decay, these rapidly decaying nuclides are, as a rule, obtained from a nuclide generator. Nuclide generators of this type are known. Customarily, they consist of a generator column, on the matrix of which a longer-lived precursor of the desired ratio-nuclide, the so-called mother nuclide, is fixed. The short-lived ratio-nuclide, the so-called daughter nuclide, can be washed out (eluted) with a suitable eluent solution from the generator column immediately before it is employed as a diagnostic agent, and since it is continuously re-formed from the longer-lived mother nuclide, it can repeatedly be separated off after a certain recovery time.

In order to obtain an injectable product, all the components of such a generator, for example the eluting agent, the generator column, the container for elute and the connections between the generator column, the container for eluting agent and the container for elute, must be assembled in a sterile and pyrogen-free manner.

It is necessary that the preparations and, in particular, the elution of a nuclide generator can be carried out simply, rapidly and safely. Above all, the exposure for the operator to radiation should be kept as low as possible. Moreover, it is necessary that the design of the generator can largely exclude operating errors. In addition, the construction of the device should be as compact as possible so that, with optimum radiation shielding, the weight of lead reaches a minimum.

The most important nuclide generator is the technetium-99 m generator, in which radioactive molybdenum-99, which decays to technetium-99 m and can be eluted in the form of pertechnetate using physiological saline, is fixed on the aluminum oxide matrix of the generator column. Technetium-99 m has radiation properties which are favorable for nuclear-medical investigations ($\gamma$-emitter having an energy of 140 keV) and a suitable half-life of 6 hours.

U.S. Pat. No. 3,576,998 has disclosed a nuclide generator in which the generator column and a container for eluting agent are connected to one another and located in a vessel. The disadvantage is a complicated and voluminous construction. Therefore, additional lead screening which is frequently applied by the user, must inevitably become unnecessarily heavy.

SUMMARY OF THE INVENTION

It is the object to provide a nuclide generator in compact construction, the generator column, the container for eluting agent and the container for eluate being forced to be connected at the points provided for this purpose as the result of a special design of the assembly of the device.

The object is achieved by a nuclide generator which consists of a generator column which is provided with radiation shielding and which is connected to a container for eluting agent and has a connection to a container for eluate, the generator column and the container for eluting agent being located in a vessel, which nuclide generator comprises the generator column, with its radiation shielding, being located in a fixed position relative to the vessel between two centering devices and being connected via a cannula to the container for eluting agent which is held in a recess of one centering device in a fixed position relative to the generator column, and the generator column having a second cannula for connecting it to the container for eluate and the other centering device having a recess for guiding the container for eluate.

It can be advantageous also to hold the cannulae in a fixed position by means of the centering devices.

Metals and plastics are suitable for use as the centering devices. Elastic plastics, such as polypropylene, have proved to be particularly advantageous.

The device according to the invention is described by way of example in FIGS. 1 and 2.

DETAILED DESCRIPTION

Figure 1:
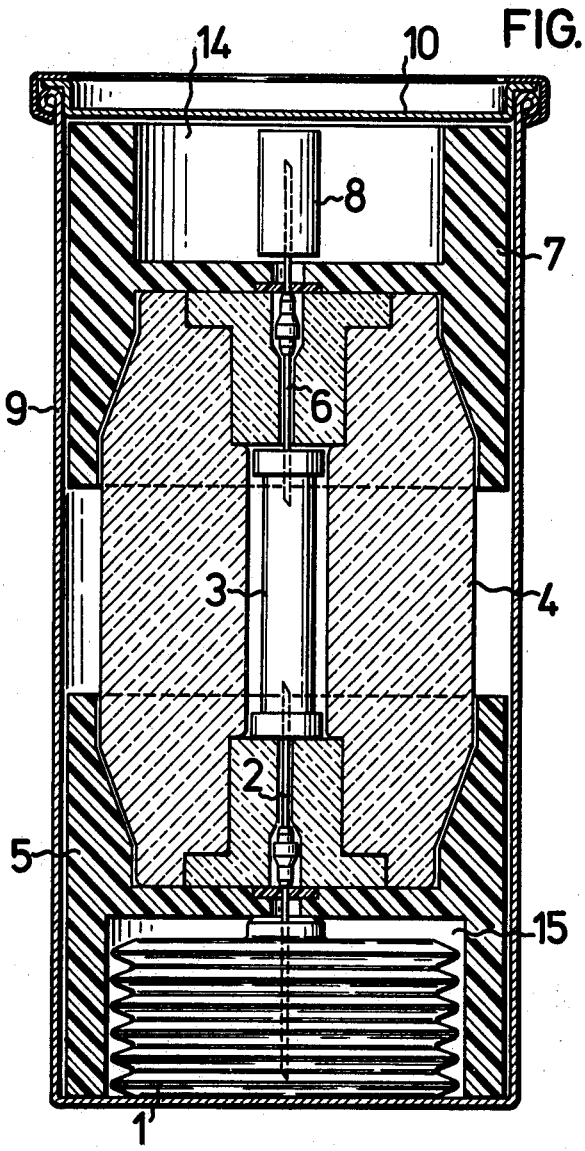
FIG. 1 shows the generator in the form in which it is envisaged to be transported.
Figure 2:
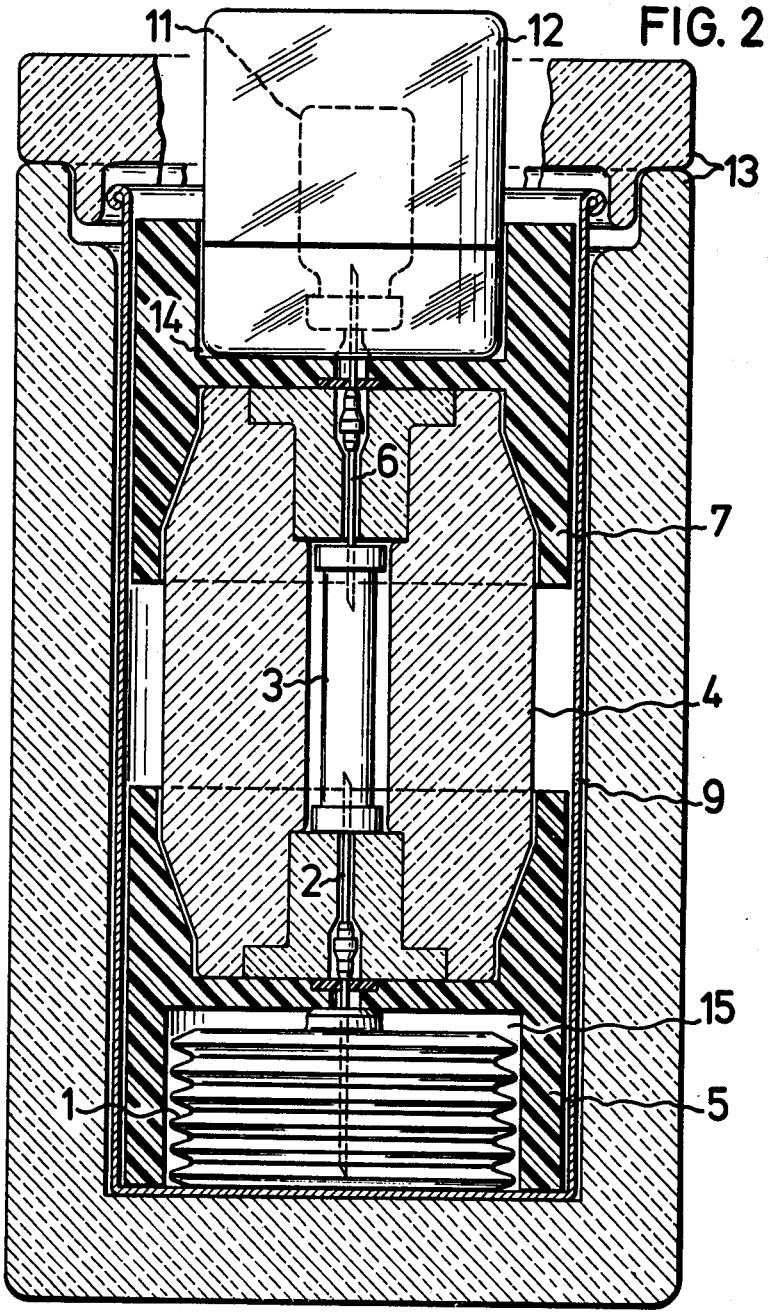
FIG. 2 shows the generator during an elution and provided with additional radiation shielding.

A vessel (1), containing physiological saline, is connected by means of the cannula (2), preferably a twin cannula, to the generator column (3) which is surrounded by a radiation shield (4), for example of lead. The centering device (5) holds the container for eluting agent, the generator column, the radiation shielding and the cannula in the correct positions. The container for eluting agent is located in a recess (15) of the centering device (5). Molybdenum-99 is fixed on the aluminum oxide matrix of the generator column. A second cannula (6), preferably a twin cannula, is connected to the second end of the generator column; it is held by a centering device (7) and is closed by a protection device (8) for the cannula. A lid (10) closes off the vessel (9) in which the generator is packaged ready for despatch. The centering devices (5) and (7) additionally ensure correct positioning and protection of the generator in transit.

To elute the generator, the lid (10) of the vessel (9) is opened, the protective device (8) for the cannula is removed and an evacuated container (11) for eluate, which is located in a transparent radiation shield (12) of lead glass, is connected via the cannula (6) to the generator column (3). The recess (14) of the centering device (7) here serves as a guide. Further lead screening (13) is used during the elution of the generator for additional radiation shielding. After the elution has ended, the container (11) for eluate is removed and the protective device (8) for the cannula is placed on again. It serves for sterile protection and protection against contamination.

I claim:

1. A nuclide generator for preparing a sterile and pyrogen-free radioactive solution, comprising a vessel; a radiation shield disposed in said vessel; a generator column positioned within said radiation shield; a first centering device positioned at one end of said vessel; a second centering device positioned at the other, opposite end of said vessel remote from said first centering device, said generator column being located between said first and second centering devices and being fixedly positioned by said first and second centering devices; said first centering device having a recess therein; an eluting agent container disposed in the recess of said first centering device and fixedly positioned thereby relative to said generator column; a first cannula connecting said generator column to said eluting agent container; said second centering device having a recess therein adapted to receive an eluate container; and a second cannula for connecting said generator column to said eluate container; said generator column and said first and second cannulae extending generally in the axial direction of said vessel.

2. A nuclide generator of claim 1 wherein said generator column and said first and second cannulae are in axial alignment with each other.

3. The nuclide generator of claim 1 further comprising first and second means positioned between said generator column and said first and second centering devices for guiding and holding said first and second cannulae, respectively.

4. The nuclide generator of claim 3 wherein the recesses of each of said first and second centering devices are positioned outside of said radiation shield.

5. The nuclide generator of claim 4 wherein each of said first and second means is positioned within said radiation shield.

6. The nuclide generator of claim 1 further comprising an additional radiation shield disposed substantially entirely about said vessel.

* * * * *